US005657561A

United States Patent [19]

Zykov

[11] Patent Number: 5,657,561

[45] Date of Patent: Aug. 19, 1997

[54] MULTI-YEAR CALENDAR DEVICE

[76] Inventor: Valeri Zykov, 6108 23rd Ave., #2F, Brooklyn, N.Y. 11204

[21] Appl. No.: 548,641

[22] Filed: Oct. 26, 1995

[51] Int. Cl.[6] ..... G09D 3/10

[52] U.S. Cl. ..... 40/118; 40/524

[58] Field of Search ..... 40/111, 118, 524, 40/526

[56] References Cited

U.S. PATENT DOCUMENTS

| | | | |
|---|---|---|---|
| 932,830 | 8/1909 | Thomas | 40/526 X |
| 1,042,337 | 10/1912 | Gorin | 40/111 X |
| 1,692,392 | 11/1928 | Stevenson | 40/111 |
| 2,686,985 | 8/1954 | Shore | 40/118 |
| 3,698,113 | 10/1972 | Spicer | 40/118 |
| 3,883,970 | 5/1975 | Campbell, Jr. | 40/118 X |
| 4,187,629 | 2/1980 | Yamada | 40/118 X |
| 5,018,289 | 5/1991 | Gelman | 40/524 X |
| 5,138,781 | 8/1992 | Claver | 40/524 |

FOREIGN PATENT DOCUMENTS

| | | | |
|---|---|---|---|
| 214587 | 3/1987 | European Pat. Off. | 40/524 |
| 603075 | 6/1994 | European Pat. Off. | 40/524 |
| 2253733 | 9/1992 | United Kingdom | 40/524 |

*Primary Examiner*—Joanne Silbermann
*Attorney, Agent, or Firm*—Michael I. Kroll

[57] ABSTRACT

A multi-year calendar device which comprises a casing having a first window and a second window therethrough. A mechanism is for manually turning a continuous belt in the casing. A person operating the manually turning mechanism can align one year date on the continuous belt in the first window to one month name on the casing and then view the numerical month dates for that particular month of that particular year through the second window in the casing.

1 Claim, 3 Drawing Sheets

MULTI-YEAR CALENDAR DEVICE

BACKGROUND OF THE INVENTION

1. Field of the Invention

The instant invention relates generally to calendars and more specifically it relates to a multi-year calendar device.

2. Description of the Prior Art

Numerous calendars have been provided in prior art. For example, U.S. Pat. No. 458,970 to Fitch; U.S. Pat. No. 1,239,220 to Roden; U.S. Pat. No. 2,447,807 to Lathrop and U.S. Pat. No. 2,768,459 to Corbett all are illustrative of such prior art. While these units may be suitable for the particular purpose to which they address, they would not be as suitable for the purposes of the present invention as heretofore described.

FITCH, HENRY

CALENDAR

U.S. Pat. No. 458,970

A perpetual calendar index consisting of parallel columns. One of the columns contains year dates. The other a series of symbols arranged opposite the year dates and indicating the day of the week on which each year commences. The character of the year, whether ordinary or leap year is substantially as and for the purpose specified.

RODEN, EPHRAIM H.

CALENDAR

U.S. Pat. No. 1,239,220

A calendar comprising thirteen parallel columns. One of the columns is a column of year dates arranged consecutively with the leap years displayed in a distinctive manner. The other twelve coles are month columns designated January to December month coles respectively. Each is made up of seven recurring symbols which have a consecutive relation with each other and relate to the days of the week. The symbols are arranged in consecutive order in each month column except in the January and February month columns where one symbol is dropped from the consecutive order between each leap year and the year following such leap year. In each of the other ten month columns one symbol is dropped from the regular consecutive order between each leap year and the year previous to such leap year.

LATHROP, HARVEY

CALENDAR HAVING FOLDING ADJUSTABLE DATE ELEMENTS SLIDABLY RECEIVABLE IN SUPPORTING FRAME

U.S. Pat. No. 2,447,807

In an adjustable calendar device, a month indicating element comprising a series of hingedly connected rigid sections bearing different month markings thereon. The hinges are of such character that any section may be folded back to lie flatwise against its adjacent section. The doubling under of selected sections will form an adjusted flat unit of reduced length displaying on its exposed face only a selected group of month markings. A supporting frame comprises a rear wall and grooved side walls. The flat unit is removably insertable endwise into the grooves, for snug accommodation in the region between them. A removable shield is adapted to overlie the accommodated unit and is provided with an aperture revealing only one of the month markings.

CORBETT, CARL C.

MULTI-YEAR CALENDARS

U.S. Pat. No. 2,768,459

A calendar comprising an opaque casing open at one end and a slide movable longitudinally within the casing. The casing has thereon a table of years arranged in vertical and horizontal rows, a listing of the months and a table of twenty eight key characters, all different, also arranged in vertical and horizontal rows. The key characters are adjacent to and interrelated with the rows of years and with the listing of the months in such a way that the position of each key character in the table corresponds with a particular month of some particular year. The slide has thereon numbers indicating the days of the month. The numbers are arranged in rows and vertical columns. The slide also has a row of key characters parallel with the side edges thereof and correspond with the key characters on the casing. The casing has a four sided window of such size as to expose a group of the numbers indicating the days of some one month only, and has the names of the days of the week arranged in a horizontal row adjacent one edge of the window. The casing also has a separate relatively small window disposed in line with the row of key characters on the slide. The small window is of such size as to render the key characters visible one at a time as the slide is moved along.

SUMMARY OF THE INVENTION

A primary object of the present invention is to provide a multi-year calendar device that will overcome the shortcomings of the prior art devices.

Another object is to provide a multi-year calendar device that will display the days of the week of any month of any year of a twenty eight or fifty six year cycle.

An additional object is to provide a multi-year calendar device that is compact in size, so that it can be carried by a person and contains one manual control knob for quick setting of the different calendar years.

A further object is to provide a multi-year calendar device that is simple and easy to use.

A still further object is to provide a multi-year calendar device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
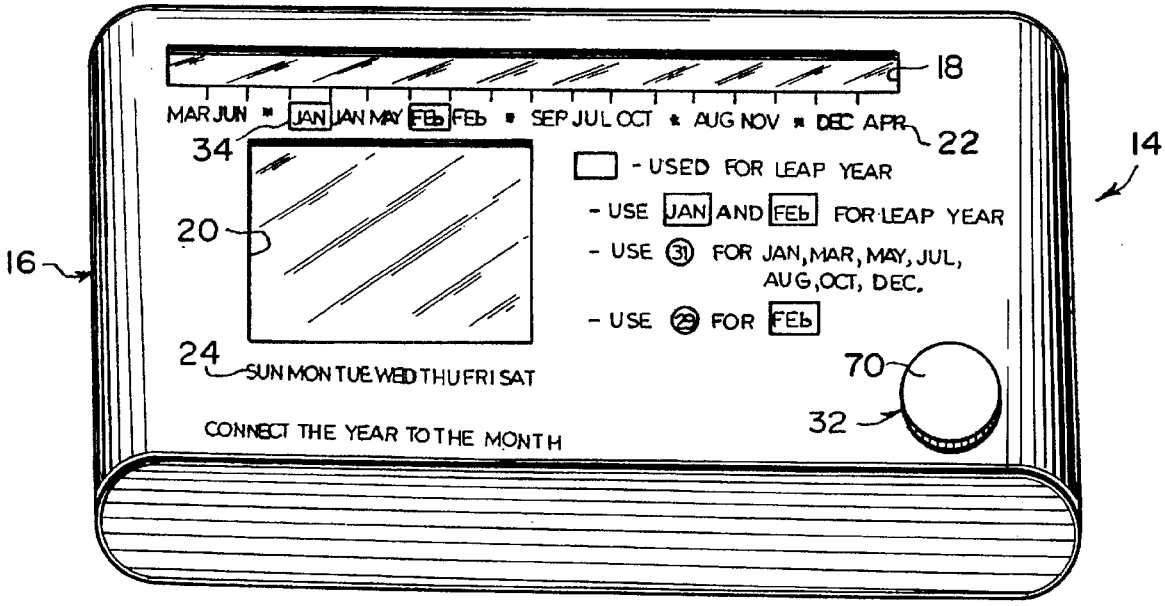
FIG. 1 is a perspective view of a first embodiment of the instant invention for a fifty six year span calendar.

Turning now descriptively to the drawings, in which similar reference characters denote similar elements throughout the several views, FIGS. 1 through 13. illustrate a multi-year calendar device 14 which comprises a casing 16 having a first window 18 and a second window 20 therethrough. Names of each month of a year 22 are placed onto the casing 16 in a specific pattern therealong, in which two additional month names indicate a leap year. Names of each day of a week 24 are placed onto the casing 16 in a normal consecutive order therealong. A continuous belt 26 is carried within the casing 16.

A plurality of year dates 28 are on the continuous belt 26 in a specific pattern thereacross to be viewed through the first window 18 in the casing 16. A plurality of numerical month dates 30 are on the continuous belt 26 in specific set patterns thereacross to be viewed through the second window 20 in the casing 16. A mechanism 32 is for manually turning the continuous belt 26 in the casing 16. A person operating the manually turning mechanism 32 can align one year date 28 in the first window 18 to one month name 22 on the casing 16, and then view the numerical month dates 30 for that particular month of that particular year through the second window 20 in the casing 16.

The names of each month of the year 22 are abbreviated, twelve in number, and being "JAN" "FEb", "MAR", "APR", "MAY", "JUN", "JUL", "AUG", "SEP", "OCT", "NOV" and "DEC" in the specific pattern. The names of the two additional months are "JAN" and "FEb" which are in a box 34 to indicate the leap year. The names of each day of the week 24 are abbreviated, seven in number and being "SUN", "MON", "TUE", "WED", "THU", "FRI" and "SAT" in the normal consecutive order.

Some of the year dates 28 are in a box 36 to indicate the leap years. Each set pattern of the numerical month dates 30 are the numbers "1" through "31". The number "29" is in a circle 38 to be used with the boxed "FEb" 34 for the leap year. The number "31" is also in a circle 40 to be used with the abbreviated months "JAN", "MAR", "MAY", "JUL", "AUG", "OCT" and "DEC".

The continuous belt 26 includes a plurality of plate strips 42 being rectangular shaped in a side by side relationship. Each plate strip 42 can contain one year date 28 and some of the numerical month dates 30.

Figure 2:
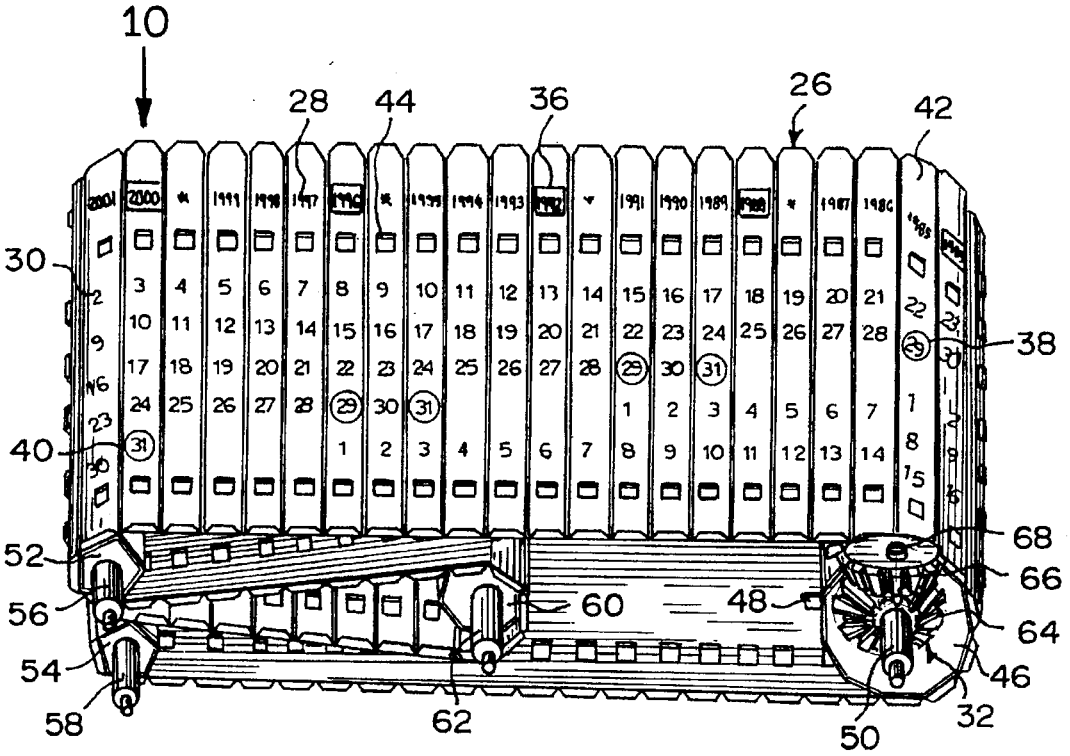
FIG. 2 is a perspective view of the belt assembly used in FIG. 1.

The manually turning mechanism 32, as best seen in FIG. 2, consists of each plate strip 42 having two spaced apart sprocket holes 44 with the year date 28 and the numerical month dates 30 placed vertically therealong. A sprocket drum 46 is at a first side of the casing 16. The sprocket drum 46 has teeth 48 to engage with the sprocket holes 44 in the plate strips 42 of the continuous belt 26. A first shaft 50 extends through the sprocket drum 46 in the easing 16, so that the sprocket drum 46 can rotate within the casing 16.

A pair of guide drums 52, 54 are at a second side of the casing 16. The guide drums 52 are positioned one under the other, so that the continuous belt 26 can loop about the guide drums 52. Second and third shafts 56, 58 are provided. They extend through the guide drums 52, 54 in the casing, so that the guide drums 52, 54 can rotate within the casing 16. An adjustable tension drum 60 is approximately midway between the sides of the casing 16. The adjustable tension drum 60 is positioned so that the continuous belt 26 can extend thereabout.

A fourth shaft 62 extends through the adjustable tension drum 60 in the casing 16, so that the tension drum 60 can rotate within the casing 16 and keep the continuous belt 26 taut. A first bevel gear 64 is on one side of the first shaft 50. A second bevel gear 66 is at a right angle to and in engagement with the first bevel gear 64. A post 68 extends upwardly from the second bevel gear 66 and through a top surface of the casing 16. A knurled control knob 70 is on a distal end of the post 68. The knurled control knob 70 can be manually operated to turn the continuous belt 26 within the casing 16.

Figure 3:
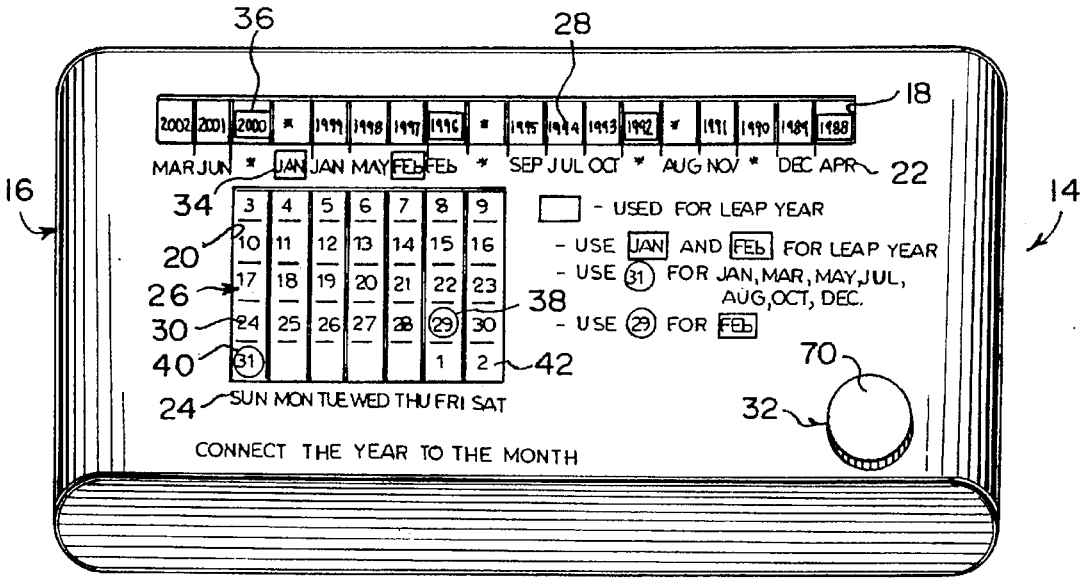
FIG. 3 is a perspective view similar to FIG. 1, with the transparent cover plates removed therefrom.
Figure 4:
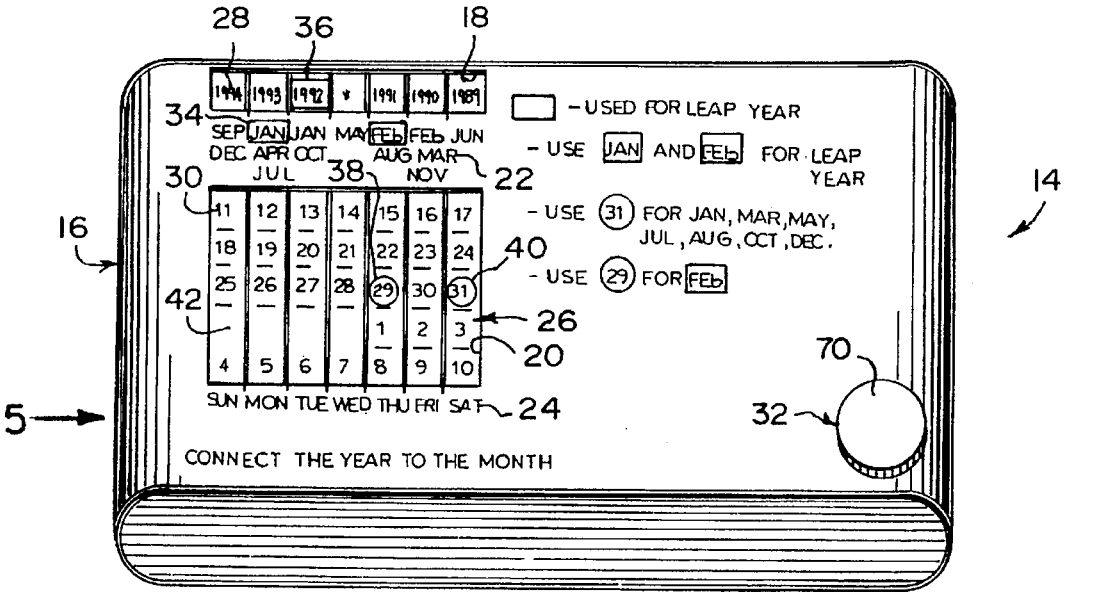
FIG. 4 is a perspective view of a second embodiment of the instant invention for a twenty eight year span calendar.
Figure 5:
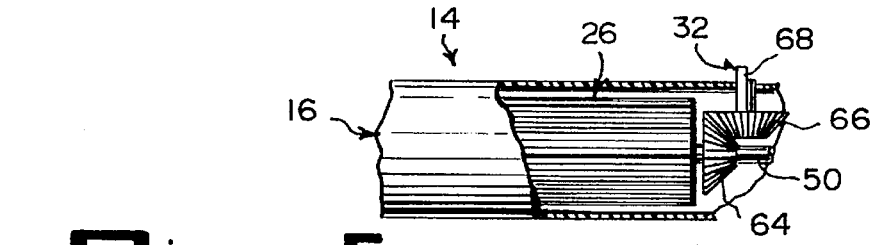
FIG. 5 is an end view taken in the direction of arrow 5 in FIG. 4 with parts broken away and in section.

The continuous belt 26 in FIG. 2 and 3, is constructed to be representative for a cycle of fifty six calendar years and has a total of seventy plate strips 42. The continuous belt 26 in FIGS. 4, 5, 6 and 7 is constructed to be representative for a cycle of twenty eight calendar years and has a total of thirty five plate strips 42.

Figure 7:
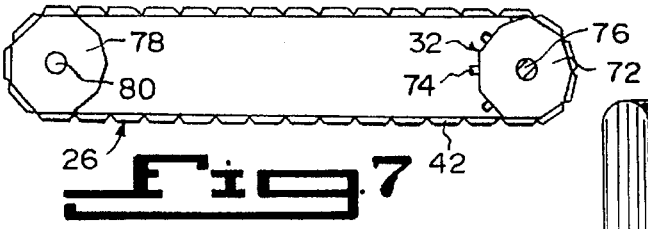
FIG. 7 is a diagrammatic side view of the belt assembly used in FIG. 6.
Figure 8:
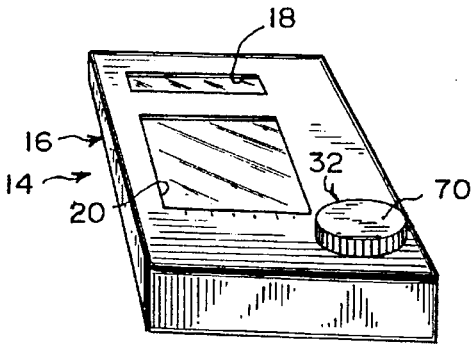
FIG. 8 is a perspective view, showing a variant casing for the second embodiment in FIG. 4.
Figure 9:
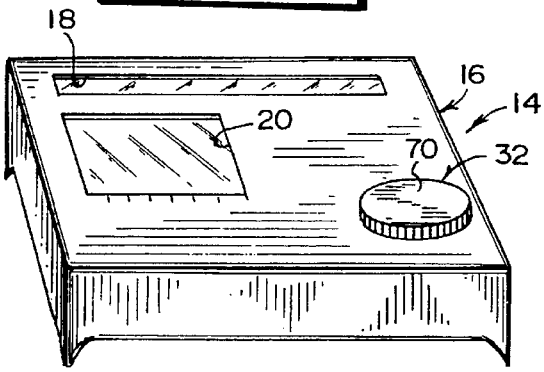
FIG. 9 is a perspective view, showing a variant casing for the first embodiment in FIGS. 1 through 3.
Figure 6:
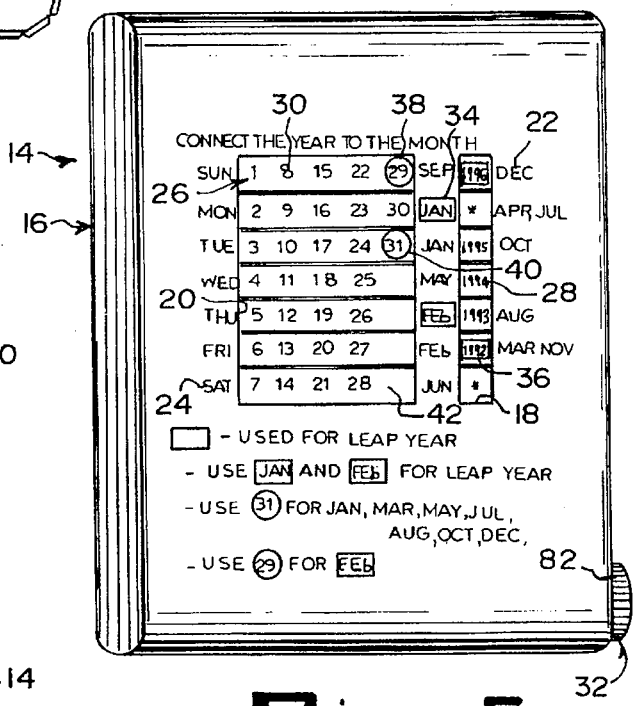
FIG. 6 is a perspective view of a third embodiment of the instant invention for a twenty eight year span calendar.
Figure 10:
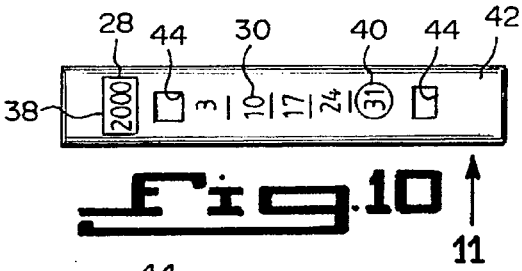
FIG. 10 is a top view of one plate strip of the belt as indicated by arrow 10 in FIG. 2.
Figure 11:
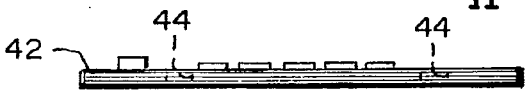
FIG. 11 is a side view of the plate strip as indicated by arrow 11 in FIG. 10.
Figure 12:
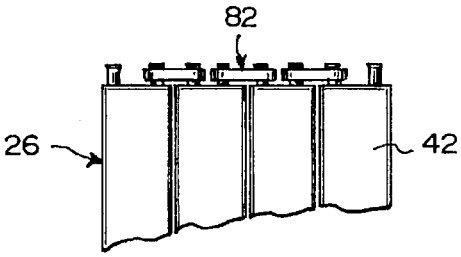
FIG. 12 is a top view of a portion of a chain link type belt.
Figure 13:
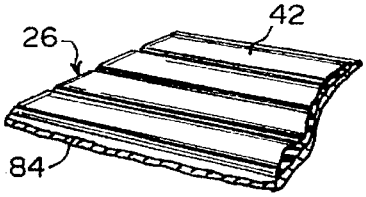
FIG. 13 is a perspective view of a portion of a cloth base type belt.

The manually turning mechanism 32 in FIGS. 6 and 7, consists of each plate strip 42 having two spaced apart sprocket holes 44 as in FIG. 10, but with the year date 28 and the numerical month dates 30 placed horizontally thereal-ong. A sprocket drum 72 is at a first side of the casing 16. The sprocket drum 72 has teeth 74 to engage with the sprocket holes 44 in the plate strips 42 of the continuous belt 26.

A first shaft 76 extends through the sprocket drum 72 in the casing 16, so that the sprocket drum 72 can rotate within the casing 16. A guide drum 78 is at a second side of the casing 16, so that the continuous belt 26 can extend around the guide drum 78. A second shaft 80 extends through the guide drum 78 in the casing 16, so that the guide drum 78 can rotate within the casing 16. A knurled control knob 82 is on a distal end of the first shaft 76 extending through an end of the casing 16. The knurled control knob 82 can be manually operated to turn the continuous belt 26 within the casing 16.

The plate strips 42 on the continuous belt 26 can be held together in the side by side relationship by a chain link assembly 82 on opposite sides thereof, as shown in FIG. 2. The plate strips 42 on the continuous belt 26 can also be held together by being secured onto a flexible endless base band 84, as shown in FIG. 14.

LIST OF REFERENCE NUMBERS

| | |
|---|---|
| 14 | multi-year calendar device |
| 16 | casing of 14 |
| 18 | first window in 16 |
| 20 | second window in 16 |
| 22 | names of a month of a year on 16 |
| 24 | name of a day of a week on 16 |
| 26 | continuous belt in 16 |
| 28 | year date on 26 |
| 30 | numerical month date on 26 |
| 32 | manually turning mechanism in 16 |
| 34 | boxed month for leap year |
| 36 | boxed year date for leap year |
| 38 | circled number "29" |
| 40 | circled number "31" |
| 42 | plate strip of 26 |
| 44 | sprocket hole in 42 |
| 46 | sprocket drum |
| 48 | tooth on 46 |
| 50 | first shaft for 46 |
| 52 | first guide drum |
| 54 | second guide drum |
| 56 | second shaft for 52 |
| 58 | third shaft for 54 |
| 60 | adjustable tension drum |
| 62 | fourth shaft for 60 |
| 64 | first bevel gear on 50 |
| 66 | second bevel gear |
| 68 | post on 66 |
| 70 | knurled control knob |
| 72 | sprocket drum |
| 74 | sprocket drum |
| 74 | teeth on 72 |
| 76 | first shaft for 72 |
| 78 | guide drum |
| 80 | second shaft for 78 |
| 82 | chain link assembly on 26 |
| 84 | flexible endless base band |

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A multi-year calendar device which comprises:

a) a casing having a first window and a second window therethrough;

b) means for each month of a year placed onto said casing in a specific pattern therealong adjacent to and aligned along said first window, in which two additional month names indicate a leap year;

c) names of each day of a week placed onto said casing in a normal consecutive order therealong;

d) a single endless continuous belt carried within said casing comprising a plurality of rectangular plate strips in a side by side relationship;

e) a plurality of year dates on said continuous belt in a specific pattern thereacross to be viewed through said first window in said casing in which each plate strip has a calendar year date, some of year dates being boxed to indicate leap years;

f) a plurality of numerical days of the month on each of said plate strips of said continuous belt in specific set patterns along each strip when viewed through said second window in said casing;

g) means for manually turning said continuous belt in said casing to align one said calendar year date in said first window to one said month name on said casing and permitting the viewing of said numerical days of the month for that particular month of that particular year through said second window on a strip carrying said calendar year date in said casing; and h) said means for manually turning said continuous belt comprising sprocket holes vertically spaced along each of said plate strips, a sprocket drum at a first side of said casing having teeth to engage said sprocket holes, a first shaft extending though said sprocket drum in said casing for rotating said sprocket drum, a pair of guide drums at a second side of said casing positioned to permit said continuous belt to loop about said guide drums, second and third shafts extending through each of said guide drums to permit rotation of said guide drums, an adjustable tension drum approximately midway between the sides of said casing positioned so that said continuous belt can extend thereabout, a fourth shaft extending through said tension drum in said casing to permit said tension drum to rotate and keep said continuous belt taut, bevel gear means connected to drive said first shaft, and a single knurled control knob on the face of said casing connected to said bevel gear means to manual control the movement of said endless continuous belt within said casing.

* * * * *